US006398337B1

(12) United States Patent
Wyble et al.

(10) Patent No.: US 6,398,337 B1
(45) Date of Patent: Jun. 4, 2002

(54) INK JET PRINTHEAD SCRUBBING AND PRIMING APPARATUS AND METHOD

(75) Inventors: Thomas J. Wyble, Williamson; Richard E. Butts, Rochester; Jacques Webster-Curley, Perry, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/429,657

(22) Filed: Oct. 29, 1999

(51) Int. Cl.[7] ..... B41J 2/165
(52) U.S. Cl. ..... 347/30; 347/23; 347/29
(58) Field of Search ..... 347/30, 29, 35, 347/23, 14, 92, 19

(56) References Cited

U.S. PATENT DOCUMENTS 4,638,337 A 1/1987 Torpey et al. ..... 347/65
4,679,059 A 7/1987 Dagna ..... 347/50
4,745,414 A * 5/1988 Okamura et al. ..... 347/29
4,863,717 A 9/1989 Keana ..... 424/9
6,019,451 A * 2/2000 Kawaguchi et al. ..... 347/29
6,036,299 A * 3/2000 Kobayashi et al. ..... 347/30

* cited by examiner

*Primary Examiner*—John Barlow
*Assistant Examiner*—Shih-wen Hsieh
(74) *Attorney, Agent, or Firm*—Talland I. Nguti

(57) ABSTRACT

An ink jet printhead scrubbing and priming method and apparatus are provided. The apparatus of the method includes a capping member for capping a nozzle face of an ink jet printhead. The capping member has a bottom wall and side walls defining a capping recess and a priming path into the capping recess. A nozzle face of an ink jet printhead being capped, the bottom wall and side walls of the capping member together define an enclosed gap within the capping recess that contains air. The apparatus of the method then includes pressure applying devices for alternatingly applying positive and negative pressure within the enclosed gap and to nozzles in the nozzle face of the ink jet printhead being capped. The positive and negative pressures effectively agitate and scrub the nozzles in the nozzle face of the ink jet printhead being capped, thereby facilitating easy and effective subsequent priming of the nozzles in the nozzle face of the ink jet printhead being capped.

8 Claims, 3 Drawing Sheets

INK JET PRINTHEAD SCRUBBING AND PRIMING APPARATUS AND METHOD

BACKGROUND OF THE INVENTION

The present invention relates generally to ink jet printers including printheads and, more particularly, to an assembly and method for scrubbing and priming each such printhead during periodic maintenance procedures.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice or nozzle until the current pulse has ceased and the bubble begins to collapse. At that stage, the ink within the channel retracts and separates from the bulging ink which forms a droplet moving in a direction away from the channel and towards a recording medium. The channel is then refilled by capillary action, drawing ink from a supply container.

One particular example of a type of thermal ink jet printer is described in U.S. Pat. No. 4,638,337. That printer is of the carriage type and has a plurality of printheads, each with its own ink supply cartridge, mounted on a reciprocating carriage. The channel orifices or nozzles in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It has been recognized that there is a need to maintain the ink ejecting orifices of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles. Maintenance and/or priming stations for the printheads of various types of ink jet printers are described in, for example, U.S. Pat. No. 4,863,717 and the removal of gas from the ink reservoir of a printhead during printing is described in U.S. Pat. No. 4,679,059. All of these patents are hereby incorporated by reference.

Air bubbles in different locations of the ink path that feeds the thermal ink jet printhead can range from harmless to very problematic.

Removing these bubbles can be very difficult and requires the removal of large amounts of ink in order to "pull" the air bubble out. The problem is that air bubbles are difficult to break up and pull through the small nozzles of the printhead.

SUMMARY OF THE INVENTION

In accordance with the present invention, there is provided a scrubbing and priming method and apparatus for scrubbing and priming the nozzle face of an ink jet printhead. The apparatus of the method includes a capping member for capping a nozzle face of an ink jet printhead.

The capping member has a bottom wall and side walls defining a capping recess and a priming path into the capping recess. A nozzle face of an ink jet printhead being capped, the bottom wall and side walls of the capping member together define an enclosed gap within the capping recess that contains air. The apparatus of the method then includes pressure applying devices for alternatingly applying positive and negative pressure within the enclosed gap and to nozzles in the nozzle face of the ink jet printhead being capped. The positive and negative pressures effectively agitate and scrub the nozzles in the nozzle face of the ink jet printhead being capped, thereby facilitating easy and effective subsequent priming of the nozzles in the nozzle face of the ink jet printhead being capped.

BRIEF DESCRIPTION OF THE DRAWINGS

In the detail description of the invention presented below, reference is made to the drawings, in which.

DESCRIPTION OF THE INVENTION

Figure 1:
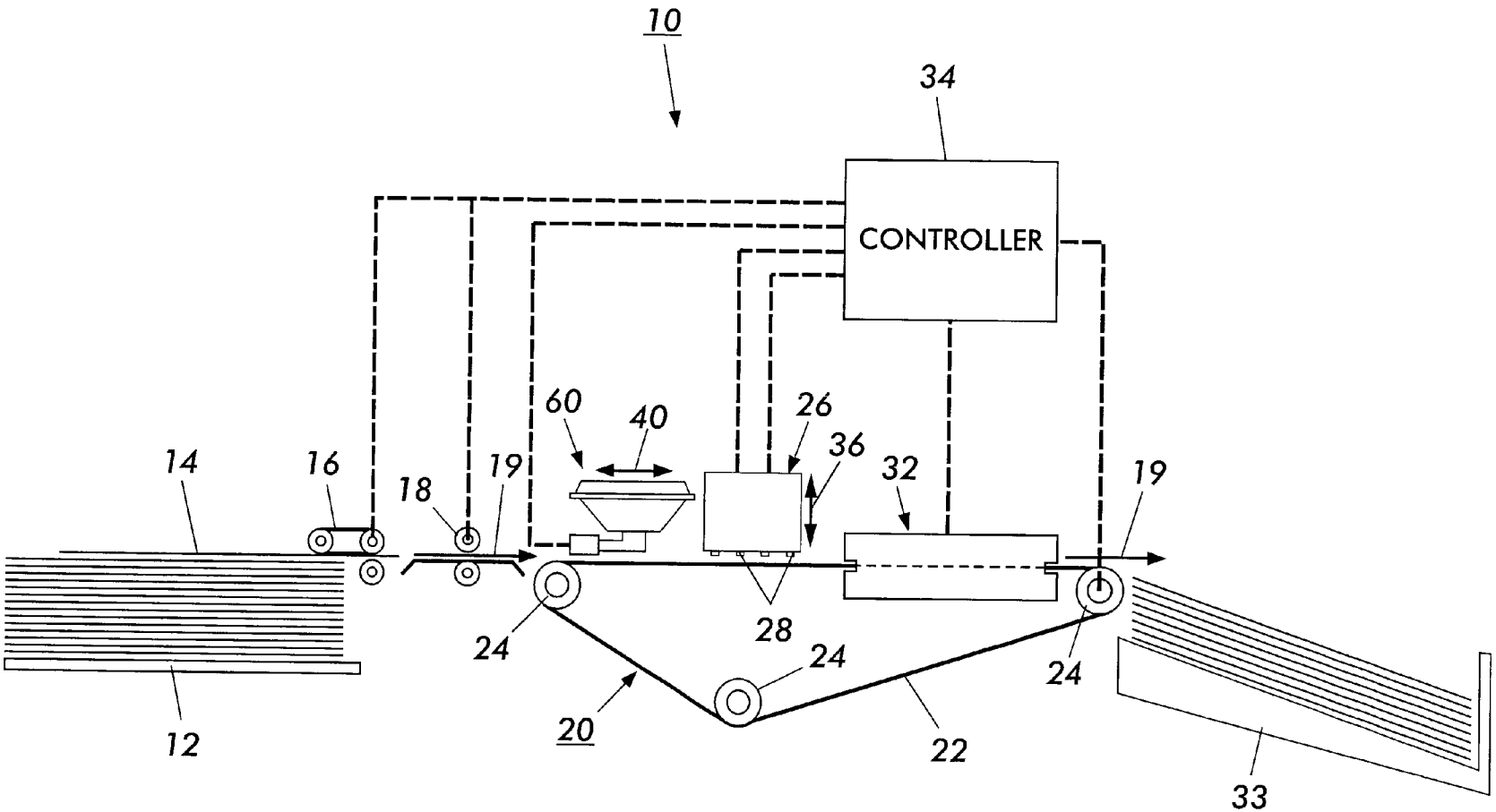
FIG. 1 is a schematic elevational view of a liquid ink printer including the printhead scrubbing and priming apparatus in accordance with the present invention.

While the present invention will be described in connection with a preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

Referring now to FIG. 1, (from D/99411/98154) there is shown a schematic elevational view of a liquid ink printer 10, for instance, an ink jet printer. As shown, the liquid ink or ink jet printer 10 incorporates the ventable printhead capping and priming apparatus 60 of the present invention, shown generally as 38 (to be described in detail below), and an input tray 12 containing sheets of a sheet of paper 14 to be printed upon by the printer 10. Single sheets of the sheet of paper 14 are removed from the input tray 12 by a pickup device 16 and fed by feed rollers 18 to a transport mechanism 20. The transport mechanism 20 moves the sheet by a feed belt or belts 22 driven by one of support rollers 24 beneath a liquid ink printhead assembly 26. The printhead assembly 26 as is well known, includes an ink supply (not labeled) attached for example to the printhead support or coupled to associated printheads through appropriate supply tubing.

The printhead assembly 26 includes printheads 28 which, for example, can be reciprocating printheads, or partial, or page width to array, printheads supported in a printing position by a printhead support (not shown) in a confronting relation with the belt 22. During printing, the printheads 28 image-wise deposit droplets of liquid ink onto the sheet of paper 14 as it is carried by the belt 22 past and beneath the plurality of printheads 28. As is well known, each of the printheads 28 includes an array of print nozzles, for instance, staggered or linear arrays, having a length sufficient to image-wise deposit droplets of ink as above, within a printing zone that lies below the printheads and is crossed the sheet of paper 14. As the sheet of paper 14 is moved through the printing zone, the printheads 28 print or record a liquid ink image on the sheet of paper 14.

After printing or recording of the liquid ink image as above within the printing zone, the sheet of paper 14 is then carried by the belt 22 through a dryer assembly 32 for drying the liquid ink image thereon. From the dryer assembly 32, the sheet of paper 14, with a dried ink image thereon is moved to an output tray 33.

As shown, a controller 34 controls the operation of various aspects of the printer 10, including the transport mechanism 20, the dryer assembly 32 and the maintenance operation including the ventable capping and priming operation in accordance with the present invention. The transport mechanism 20 for example includes the pickup device 16, the feed roller 18, the belt 22 and the drive rollers 24. In addition, the controller 34 controls the movement of the printhead assembly 26, printing by the printheads 28 as would be understood by one skilled in the art. The controller 34 is preferably a self-contained, dedicated mini-computer having a central processor unit (CPU), electronic storage, and a display or user interface (UI). With the help of sensors and connections (not shown), the controller 34 reads, captures, prepares and manages the flow of data for the image being printed by the printheads 28. In addition, the controller 34 is the main multi-tasking processor for operating and controlling all of the other machine subsystems and printing operations.

At the completion of a printing job or when otherwise necessary, such as during a power failure, the printhead assembly 26, is moved away from the belt 22 in the directions of an arrow 36. A molded capping member 52 of the prithead scrubbing and priming apparatus 60 of the present invention is moved beneath the printhead assembly 26, in the directions of the arrow 40 for capping the printheads of the printhead assembly 26. Once the prithead scrubbing and priming apparatus 60 is positioned directly beneath the printhead assembly 26, the printhead assembly 26 is moved towards the belt 22 and into sealing engagement with a raised membrane 50 on the molded capping member 52 for capping scrubbing and fully priming the printheads 28 in accordance with the present invention (to be described in detail below).

When the printhead assembly 26, has been capped, scrubbed, and fully primed as above, and is again needed for another printing job, it is moved away from the belt 22 and the prithead scrubbing and priming apparatus 60 is then moved away from the printhead assembly 26 such that the printhead assembly 26 can be repositioned appropriately with respect to the belt 22 for printing on the recording sheets 14.

Figure 2:
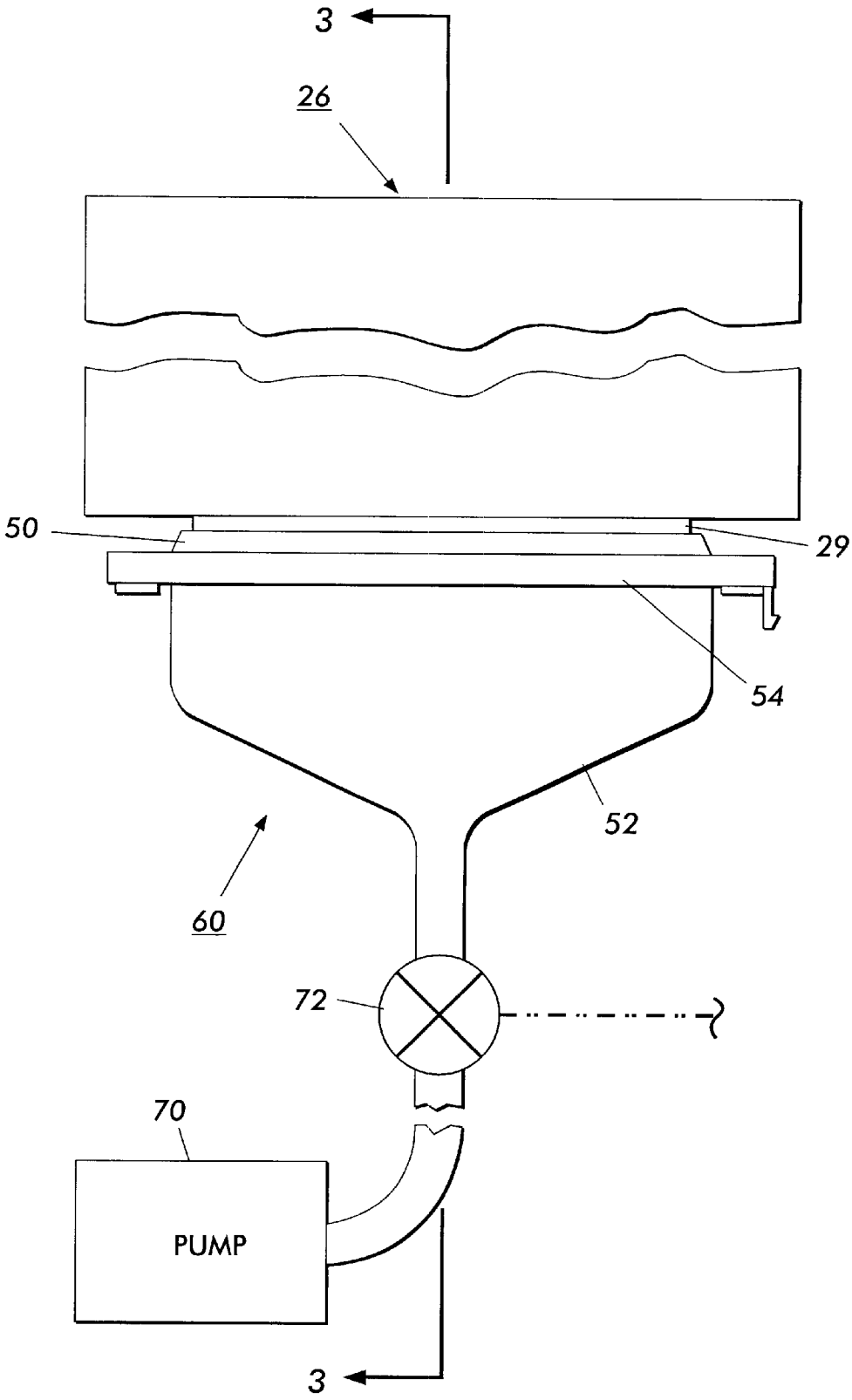
FIG. 2 is a schematic illustration of the printhead scrubbing and priming apparatus of the present invention in sealing engagement with the nozzle face of an ink jet printhead.
Figure 3:
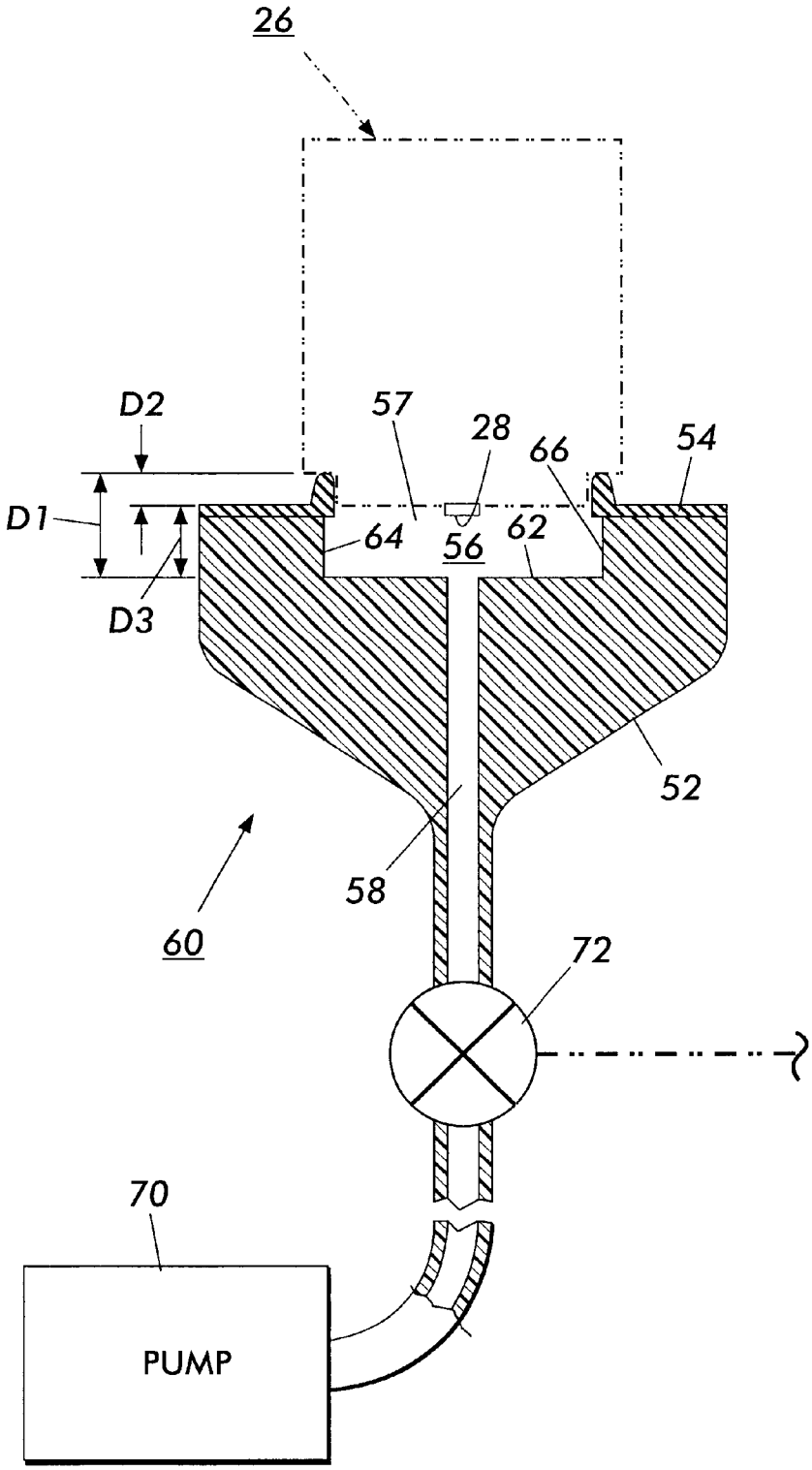
FIG. 3 illustrates a vertical section of printhead scrubbing and priming apparatus of the present invention in capped sealing engagement with the nozzle face of an ink jet printhead, a closed valve and printhead ejecting droplets for scrubbing prior to a priming operation under vacuum.

Referring now to FIGS. 1–3, the printhead assembly 26 includes for example, a reciprocating printhead 28, that has been moved into a capping position against the prithead scrubbing and priming apparatus 60 of the present invention. The prithead scrubbing and priming apparatus 60 thus caps and seals against a nozzle face 29 of the printhead 28. As shown, the prithead scrubbing and priming apparatus 60 comprises a raised membrane 50, preferably a low (20–30 shore "A") durometer silicone rubber joined to the molded capping member 52, having a substrate 54 and a chamber 56. Importantly in accordance with the present invention, the chamber 56 has a depth D1 that although shown with straight sides, may be tapered inwardly, and that terminates at a base 62 having an orifice into a priming path 58 therethrough.

As further shown, the molded capping member 52 includes the bottom wall 62, and side walls 64, 66 defining the capping chamber or recess 56, as well as, the priming path 58 from the vacuum device 70 into the capping chamber or recess 56. Because the nozzle face 29 is seated well above the bottom wall 62, an enclosed gap 57 having a depth D3 is formed within the capping chamber or recess 56. As illustrated, the enclosed gap 57 is thus defined by the nozzle face 29 of an ink jet printhead being capped, and by the bottom wall 62 and side walls 64, 66 of the capping member 52. The enclosed gap 57 is formed after seating of the nozzle face 29, and prior to application of vacuum, and as such contains air.

Pressure applying means comprising the printhead 28, and vacuum device 70, are provided for alternatingly applying positive and negative pressure within the enclosed gap 57, and hence to nozzles in the nozzle face 29. The positive and negative pressures are sufficient to have an impact deep into the channels of the nozzles, and thus effectively function to push in and suck out air and ink within the channels, hence agitating and scrubbing such channels and nozzles. This thereby facilitates and makes for easy and effective subsequent priming of the scrubbed nozzles in the nozzle face 29.

As mentioned above, the pressure applying means include the vacuum applying device or pump 70 connected to the priming path 58, through a valve 72, for selectively applying a negative pressure suction force to the enclosed gap 57 as well as to nozzles in the nozzle face 29, so as to easily and effectively prime the nozzles. The pressure applying means also include the printhead 28 and its controller and drivers for forcibly and intermittently ejecting drops of ink from nozzles in the nozzle face 29 into the enclosed gap 57 with the valve 72 closed, thus creating positive pressure within the gap 57. Preferably, the drops of ink so ejected are heated in order to cause faster expansion of air within the gap 57, and hence greater and quicker positive pressure for forcing such expanding air into the channels of the nozzles in the face 29.

In operation, the printhead assembly with printhead 28 is seated into a top portion having a depth D2 of the chamber 56, and against member 50 thus forming the gap 57 with depth D3, and enabling the effective capping and priming operations thereof. Following seating of the printhead 28 against member 50 a vacuum pressure can selectively be applied by a vacuum device such as a pump 70, for priming the nozzles of the nozzle face 29. A typical pressure range generated during such a priming operation is from 350–400 mm Hg (6.8 psi to 7.7 psi).

The method of scrubbing and priming the printhead 28 thus includes providing a printhead capping member 52 including a bottom wall 62 and side walls 64, 66 defining a capping recess 56 having a first portion, and a second portion comprising an enclosed gap 57 containing air, and defined by the bottom wall, the side walls, and the nozzle face 29. The method next includes a step of increasing fluidic pressure within the enclosed gap 57 by forcibly ejecting drops of liquid ink from nozzles in the nozzle face into the enclosed gap 57 so as to force air contained therein back into the nozzles, thereby scrubbing the nozzles and facilitating easy and effective subsequent priming of such nozzles. The method then includes a step of applying a suction force to the enclosed gap 57 and to the nozzle face 29, using a vacuum device 70 so as to easily and effectively prime the scrubbed nozzles. The step of increasing fluidic pressure within the enclosed gap includes sealing the priming or vacuum applying path 58 into the enclosed gap 57, and then intermittently and forcibly ejecting drops of heated liquid ink from nozzles into the enclosed gap 57.

To recap, the present invention provides apparatus for, and a method of, easily and effectively depriming (i.e.

scrubbing and priming) a thermal ink jet printhead using (in part) pressure generated by firing drops of ink from a capped printhead 28 into an enclosed area 57 that is sealed by a valve 72 to prevent the pressure from escaping. Conventionally, methods of depriming a printhead involve only a pump for creating pressure to force ink out of the printhead and back into the ink supply. As disclosed above, this invention uses the printhead 28 to eject drops of ink into a cap member 52 that is part of the printhead maintenance system. The cap member is temporarily sealed leaving an enclosed gap between a nozzle face 29 of the printhead, so that ejecting drops of ink into the enclosed area causes the air pressure within the enclosed area to rise. This happens because the added ink displaces the air within the enclosed area, and because the hot ink from the thermal printhead heats the air. When the air pressure gets high enough, it will push the ink back into the nozzles towards the ink supply.

It is recalled that ordinarily, removing air bubbles from the ink path of a printhead can be very difficult and requires the removal of large amounts of ink in order to "pull" the air bubble out. The problem is that air bubbles are difficult to break up and pull through the small nozzles of the printhead. The apparatus and method of the present invention effectively force air from the enclosed gap 57 back into the nozzles and into the ink path, thus eliminating ant air bubbles therein. Once the air bubbles are gone, a normal prime using the vacuum pump 70 is then performed. The result is a bubble free ink path.

As can be seen, there has been provided a scrubbing and priming method and apparatus for scrubbing and priming the nozzle face of an ink jet printhead. The apparatus of the method includes a capping member for capping a nozzle face of an ink jet printhead. The capping member has a bottom wall and side walls defining a capping recess and a priming path into the capping recess. A nozzle face of an ink jet printhead being capped, the bottom wall and side walls of the capping member together define an enclosed gap within the capping recess that contains air. The apparatus of the method then includes pressure applying devices for alternatingly applying positive and negative pressure within the enclosed gap and to nozzles in the nozzle face of the ink jet printhead being capped. The positive and negative pressures effectively agitate and scrub the nozzles in the nozzle face of the ink jet printhead being capped, thereby facilitating easy and effective subsequent priming of the nozzles in the nozzle face of the ink jet printhead being capped While the embodiment disclosed herein is preferred, it will be appreciated from this teaching that various alternative, modifications, variations or improvements therein may be made by those skilled in the art, which are intended to be encompassed by the following claims:

What is claimed is:

1. A method of scrubbing and priming an ink jet printhead, the method comprising the steps of:

(a) providing a printhead capping member including a bottom wall and side walls defining a capping recess having a first portion and a second portion;

(b) forming an enclosed gap containing air within the second portion of the capping recess, the enclosed gap being defined by the bottom wall, the side walls, and a nozzle face of a liquid ink containing printhead inserted into the first portion of the capping recess;

(c) increasing fluidic pressure within the enclosed gap by forcibly ejecting drops of liquid ink from nozzles in the nozzle face of the liquid ink containing printhead into the enclosed gap so as to force air contained therein back into the nozzles, thereby scrubbing the nozzles and facilitating easy and effective subsequent priming of the nozzles; and (d) applying a suction force to the enclosed gap and to the nozzle face of the liquid ink containing printhead so as to easily and effectively prime the nozzles.

2. The method of claim 1, wherein the step of increasing fluidic pressure within the enclosed gap includes intermittently and forcibly ejecting drops of liquid ink from nozzles in the nozzle face of the liquid ink containing printhead into the enclosed gap.

3. The method of claim 1, wherein the step of increasing fluidic pressure within the enclosed gap includes forcibly ejecting drops of heated liquid ink from nozzles in the nozzle face of the liquid ink containing printhead into the enclosed gap.

4. The method of claim 1, wherein the step of increasing fluidic pressure within the enclosed gap includes a step of sealing a vacuum applying path into the enclosed gap.

5. An ink jet printhead scrubbing and priming apparatus comprising:

(a) a capping member for capping a nozzle face of an ink jet printhead, said capping member including a bottom wall and side walls defining a capping recess, as well as a priming path into said capping recess;

(b) an enclosed gap within said capping recess, said enclosed gap containing air and being defined by a nozzle face of an ink jet printhead being capped and by said bottom wall and side walls of said capping member; and (c) pressure applying means for alternatingly applying positive and negative pressure within said enclosed gap and to nozzles in the nozzle face of the ink jet printhead being capped, said positive and negative pressures effectively agitating and scrubbing the nozzles in the nozzle face of the ink jet printhead being capped, thereby facilitating easy and effective subsequent priming of the nozzles in the nozzle face of the ink jet printhead being capped.

6. The ink jet printer of claim 5, including a vacuum applying means connected to said priming path for applying a suction force to said enclosed gap and to nozzles in the nozzle face of the ink jet printhead so as to easily and effectively prime the nozzles.

7. The ink jet printer of claim 5, wherein said pressure applying means comprises means for forcibly and intermittently ejecting drops of ink from nozzles in the nozzle face of the ink jet printhead being capped.

8. The ink jet printer of claim 7, wherein said pressure applying means comprises means for forcibly and intermittently ejecting drops of heated ink from nozzles in the nozzle face of the ink jet printhead being capped.

* * * * *